US006796814B1

(12) United States Patent
Handschke

(10) Patent No.: US 6,796,814 B1
(45) Date of Patent: Sep. 28, 2004

(54) UNIVERSAL RECEPTACLE COVER HAVING LIVING HINGE

(75) Inventor: Michael J. Handschke, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/425,533

(22) Filed: Apr. 29, 2003

(51) Int. Cl.[7] ..... H01R 13/44
(52) U.S. Cl. ..... 439/142; 220/242; 174/67
(58) Field of Search ..... 439/142, 144, 439/148; 220/242; 174/67

(56) References Cited

U.S. PATENT DOCUMENTS

| | | | | |
|---|---|---|---|---|
| 3,127,048 A | 3/1964 | Winter | 220/35 |
| 4,456,145 A | 6/1984 | Frank | 220/242 |
| 4,660,912 A | 4/1987 | Tomek | 339/44 R |
| 4,973,797 A | 11/1990 | Jorgensen et al. | 174/53 |
| 5,080,599 A | 1/1992 | Wimberly | 439/142 |
| 5,238,416 A | 8/1993 | Dickie | 439/148 |
| 5,317,108 A | 5/1994 | Prairie, Jr. | 174/67 |
| 5,430,253 A | 7/1995 | Pratt | 174/67 |
| 5,675,126 A | 10/1997 | Halvorsen | 174/67 |
| 6,127,630 A | 10/2000 | McKenzie et al. | 174/58 |

*Primary Examiner*—Javaid H. Nasri
(74) *Attorney, Agent, or Firm*—Ostrager Chong Flaherty & Broitman P.C.

(57) ABSTRACT

A power supply interface comprising electrical receptacles and intended for use outdoors or some other environment in which the receptacles can be exposed to water. Universal receptacle covers are used to cover exposed socket ends of the receptacles that have different geometric configurations. The universal receptacle cover comprises an adapter having an aperture with a geometric configuration that allows socket ends of different geometric configurations to project through the aperture. This avoids the need for receptacle covers with different configurations to accommodate the different socket ends.

24 Claims, 8 Drawing Sheets

UNIVERSAL RECEPTACLE COVER HAVING LIVING HINGE

BACKGROUND OF THE INVENTION

This invention generally relates to power supplies. More specifically, the invention relates to power supplies that are used outdoors.

Power supplies such as welding power supplies are used to provide high-amperage current. Typically, in a welding power supply, a pair of output terminals is provided. A welding cable connected to the welding torch (or stinger, drive assembly or welding circuit) is inserted into one of the two output terminals. The other output terminal receives a welding cable that is connected to the workpiece being welded. Typically, the connectors are twist-lock type connectors (also called "international connectors"), the power supply has a female connector, and the welding cable has a mating male connector. In some designs the cable has a female connector and the power supply a male connector.

Engine-driven welding power supplies are well known, and may be driven either by a DC generator or an AC generator (also called an alternator-rectifier). An AC generator generally includes, in addition to an alternator, a reactor followed by rectifiers to provide a DC output. Electrical power produced by the generator as the engine drives rotation of the rotor is converted by known electrical components into useable welding power and auxiliary power available at respective terminals.

It is not unusual for welding power supplies to be used outdoors, for example, at construction sites. Thus, they are often exposed to rain or may otherwise get wet. Also, to obtain IEC certification (or other certifications such as UL, CSA, NEMA, etc.), welding power supplies must be subjected to a "rain test". In such a test, the power supply will be exposed to water to ensure that premature failures in the field will not occur.

In one type of prior art connector for a welding power supply, a twist-lock receptacle, which receives the end of a welding cable, is mounted in an opening in a power supply chassis by means of front and rear bulkhead insulators that electrically isolate the receptacle from the chassis. However, sometimes water seeps between the front bulkhead insulator and the chassis. The water then seeps down between the front and rear bulkhead insulators. Additionally, a second potential water seepage path lies between the receptacle and the front bulkhead insulator. As water leaks in along either path, the water may provide a conductive path from the twist-lock receptacle, which is electrically hot, to the chassis, which should be grounded. Thus, either path for water leakage may provide an undesirable short circuit.

One prior art attempt to solve the problem of water leakage is to apply a room-temperature vulcanizing compound to seal the interstices that would otherwise provide a path for water leakage. Another solution, disclosed in U.S. Pat. No. 6,193,548, is to insert O-ring seals in the paths of water leakage surrounding the cable receptacle.

Yet another prior art solution is to attach a water-impermeable receptacle cover assembly to the chassis, which assembly comprises a lid coupled to an adapter or mounting ring by hinges that allow the lid to pivot between open and closed positions relative to the adapter. Alternatively, it is known to connect the lid to the adapter via a membrane or web of flexible material that forms a so-called "living hinge". In either case, the receptacle, which projects through an aperture in the adapter or mounting ring, is enclosed by the water-impermeable receptacle cover when the lid is in the closed position. A gasket is provided between the chassis and the adapter to limit water leakage into the enclosure.

Some power supplies intended for outdoor usage have multiple receptacles of different sizes and shapes. It is known to provide a respective cover of different design for each style of receptacle. For example, a receptacle that has a rectangular socket end projecting through one opening in a housing or panel would be covered by a receptacle cover assembly in which the adapter has a matching rectangular aperture, while a receptacle that has a circular socket end projecting through another opening in the housing or panel would be covered by a different receptacle cover assembly in which the adapter has a matching circular aperture. Thus, the manufacture of such power supplies requires the manufacture and inventory of different styles of receptacle covers.

There is a need for a receptacle cover design that would reduce the cost of and simplify the process of manufacturing power supplies intended for use outdoors.

BRIEF DESCRIPTION OF THE INVENTION

The invention is directed to a power supply interface comprising electrical receptacles and intended for use outdoors or some other environment in which the receptacles can be exposed to water. Universal receptacle covers are used to cover exposed socket ends of the receptacles that have different geometric configurations. The universal receptacle cover comprises an adapter having an aperture with a geometric configuration that allows socket ends of different geometric configurations to project through the aperture. This avoids the need for receptacle covers with different configurations to accommodate the different socket ends.

One aspect of the invention is a power supply interface comprising: a chassis having a first opening with a first geometric configuration and a second opening with a second geometric configuration different than the first geometric configuration; a first electrical receptacle mounted to the chassis and comprising a socket end that projects through the first opening and is designed to receive a plug of a first type; a second electrical receptacle mounted to the chassis and comprising a socket end that projects through the second opening and is designed to receive a plug of a second type different than the first type; a first receptacle cover comprising an adapter mounted to the chassis and a lid connected to the adapter by a living hinge, wherein the adapter comprises an aperture having a third geometric configuration different than the first and second geometric configurations, and the first receptacle cover covers the socket end of the first electrical receptacle when the lid of the first receptacle cover is coupled to the adapter of the first receptacle cover; and a second receptacle cover substantially identical in structure to the first receptacle cover, wherein the second receptacle cover covers the socket end of the second electrical receptacle when the lid of the second receptacle cover is coupled to the adapter of the second receptacle cover.

Another aspect of the invention is a power supply unit comprising: a generator capable of generating a first electrical power at a first output terminal and a second electrical power different than the first electrical power at a second output terminal; a chassis having a first opening with a first geometric configuration and a second opening with a second geometric configuration different than the first geometric configuration; a first electrical receptacle mounted to the chassis and electrically coupled to the first output terminal, the first electrical receptacle comprising a socket end that projects through the first opening and is designed to receive a plug of a first type; a second electrical receptacle mounted to the chassis and electrically coupled to the second output terminal, the second electrical receptacle comprising a socket end that projects through the second opening and is designed to receive a plug of a second type different than the first type; a first receptacle cover comprising an adapter mounted to the chassis and a lid connected to the adapter by a flexible web, wherein the adapter comprises an aperture having a third geometric configuration different than the first and second geometric configurations, and the first receptacle cover covers the socket end of the first electrical receptacle when the lid of the first receptacle cover is coupled to the adapter of the first receptacle cover; and a second receptacle cover substantially identical in structure to the first receptacle cover, wherein the second receptacle cover covers the socket end of the second electrical receptacle when the lid of the second receptacle cover is coupled to the adapter of the second receptacle cover.

A further aspect of the invention is a power supply interface comprising: a panel; a first electrical receptacle mounted to the panel and comprising a first socket end that has a first geometric configuration and is designed to receive a plug of a first type; a second electrical receptacle mounted to the panel and comprising a second socket end that has a second geometric configuration different than the first geometric configuration and is designed to receive a plug of a second type different than the first type; a first receptacle cover comprising an adapter mounted to the panel and a lid connected to the adapter by a flexible web, wherein the adapter comprises an aperture having a third geometric configuration different than the first and second geometric configurations, and the first receptacle cover covers the first socket end of the first electrical receptacle when the lid is coupled to the adapter; and a second receptacle cover substantially identical in structure to the first receptacle cover, wherein the second receptacle cover covers the second socket end of the second electrical receptacle when the lid of the second receptacle cover is coupled to the adapter of the second receptacle cover. In the foregoing arrangement, the first socket end of the first electrical receptacle projects through the aperture in the adapter of the first receptacle cover, while the second socket end of the second electrical receptacle projects through the aperture in the adapter of the second receptacle cover.

Yet another aspect of the invention is a method for waterproofing exposed first and second socket ends of first and second electrical receptacles mounted to a panel of a power supply unit, the first and second socket ends having different geometric configurations, respective major portions of the first and second electrical receptacles being disposed on one side of the panel, and the first and second socket ends projecting at least partly on the other side of the panel. The method comprises the following steps: molding first and second receptacle covers having substantially identical structure, each of the receptacle covers comprising an adapter with an aperture, a lid and a web connecting the lid to the adapter, the lid and the adapter forming a watertight seal when the lid is pressed onto the adapter, thereby closing the respective receptacle cover; and fastening the adapters of the first and second receptacle covers to the panel in respective positions such that the first receptacle cover in a closed state covers the first socket end as it projects through the aperture in the adapter of the first receptacle cover, while the second receptacle cover in a closed state covers the second socket end as it projects through the aperture in the adapter of the first receptacle cover.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

The present invention is directed to a receptacle cover mounted to the chassis of a power supply unit. The receptacle cover has application to welding power supply units of the type having an engine-driven generator. One such prior art power supply unit will be described with reference to FIG. 1. In addition, one type of cable receptacle, for use in the power supply unit of FIG. 1, will be described with reference to FIGS. 2 and 3.

Figure 1:
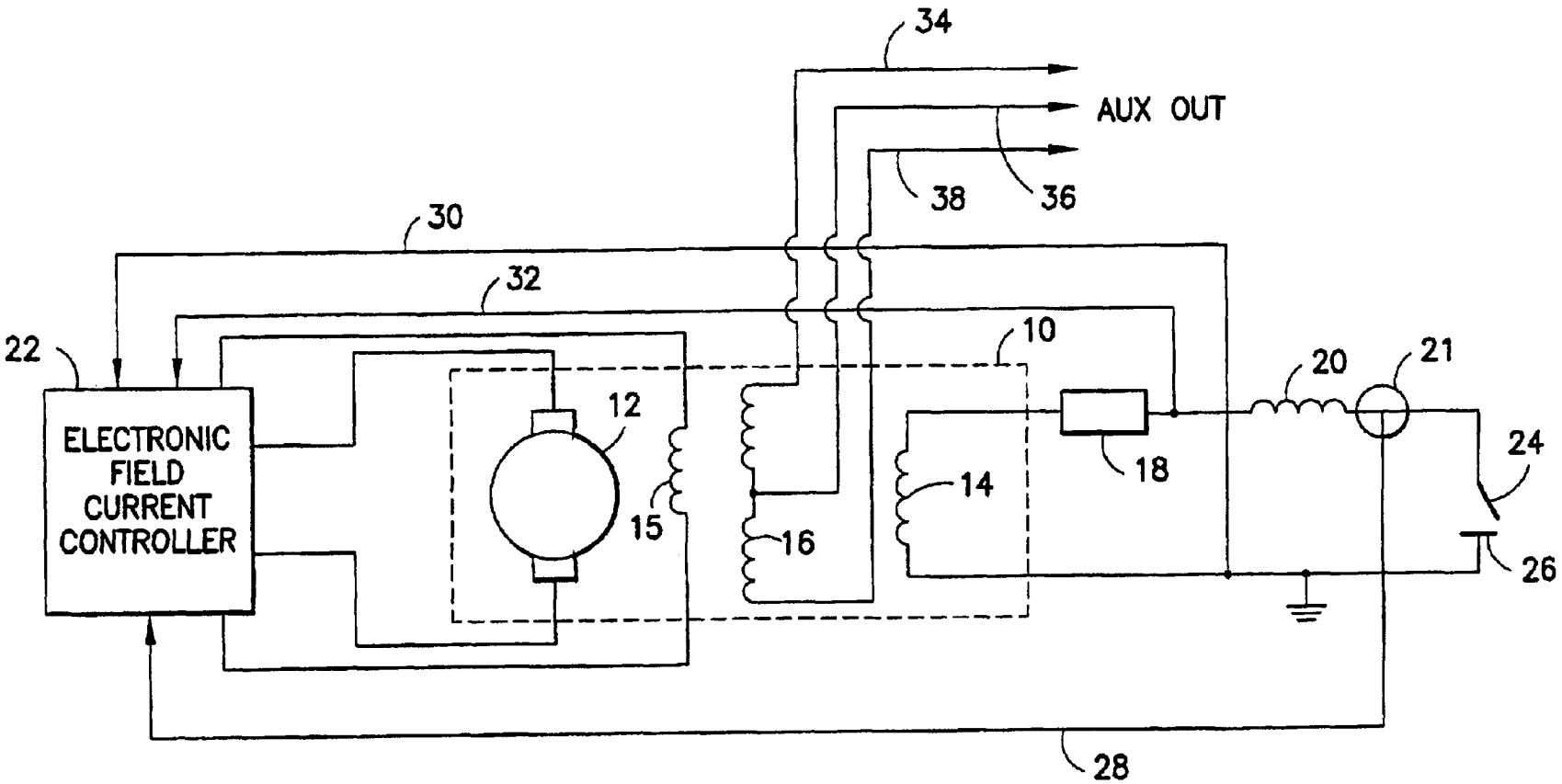
FIG. 1 PRIOR ART
FIG. 1 is a diagram of a known engine-driven welding power supply.

The system shown in FIG. 1 comprises a generator 10, an electronic field current controller board 22 for regulating the welding and auxiliary outputs of the generator 10, an output rectifier 18, an output inductor or filter 20, weld feedback lines 30 and 32, and auxiliary output lines 34, 36 and 38. The generator comprises a rotor 12 and a stator. The rotor 12 comprises a rotor winding (not shown in FIG. 1). The stator comprises various windings depicted in FIG. 1, including welding power output winding 14, exciter winding 15 and auxiliary power output windings 16. The welding power output winding provides current to an electrode 24 (typically located at the tip of a welding gun). A clamp terminal 26 is clamped to the workpiece. The winding 14 produces a desired voltage potential difference across the electrode 24 and the terminal 26.

The generator 10 may be either a three-phase or a single-phase generator. In response to current from the field current controller board 22, the rotor winding creates electromagnetic fields that induce current in the various stator windings.

The voltage and current derived by welding power output winding 14 are responsive to the magnitude of the field current provided to the rotor 12. The output of welding power output winding 14 is provided to a rectifier 18 and an output inductor 20, which provides the welding power supply to the electrode 24. The magnitude of the field current in the rotor winding is responsive to the electronic field current controller on board 22. Thus, the electronic field current controller indirectly controls the output of welding power supply.

Typically, feedback from the welding output is provided on lines 28, 30 and 32. Voltage feedback is obtained from the output of rectifier 18 and is fed back to the electronic field current controller board 22 via lines 30 and 32. Current feedback is obtained by a current sense device 21 and is fed back to the electronic field current controller board 22 via line 28. The electronic field current controller board 22 uses the current and voltage feedback to control the field current in such a manner as to provide a desired output current and voltage. The exciter winding 15 provides an output to the field current controller, which in turn provides field current to the rotor winding.

Generally, the auxiliary output windings 16 are used to provide an auxiliary power output (current, voltage and/or power). The auxiliary output is often used to power tools, lights, etc., that require 110 VAC. Thus, the auxiliary output is typically 110 VAC, but may be 240 or 480 VAC. The output may be single phase or three phase.

Typically, the welding and auxiliary power outputs are available at cable receptacles mounted to a power supply chassis or panel. For example, a welding torch comprises a welding gun at one end and a plug at the other end, which plug is inserted into a receptacle that provides the welding power supply as well of the gas supply. Similarly, a cable for an auxiliary device, such as a light, can be plugged into a receptacle that provides the auxiliary power supply.

Engine-driven welder/generators are typically used outdoors, for example, at construction sites, where they can be exposed to moisture. Water can seep between the receptacle insulator and the power supply chassis. This potential water leakage may provide a conductive path from the receptacle, which is electrically hot, to the chassis, which should be grounded. Thus, an undesirable short circuit may result.

As previously mentioned, one solution for preventing the seepage of water into the interstice between the insulator and the chassis is to cover the exposed socket end of the receptacle with water-impermeable material, such as plastic. This can be accomplished by mounting a hinged receptacle cover to the front of the power supply chassis. Preferably the receptacle cover is designed to have universal application with receptacles of many different shapes and arranged in many different arrays.

Figure 2:
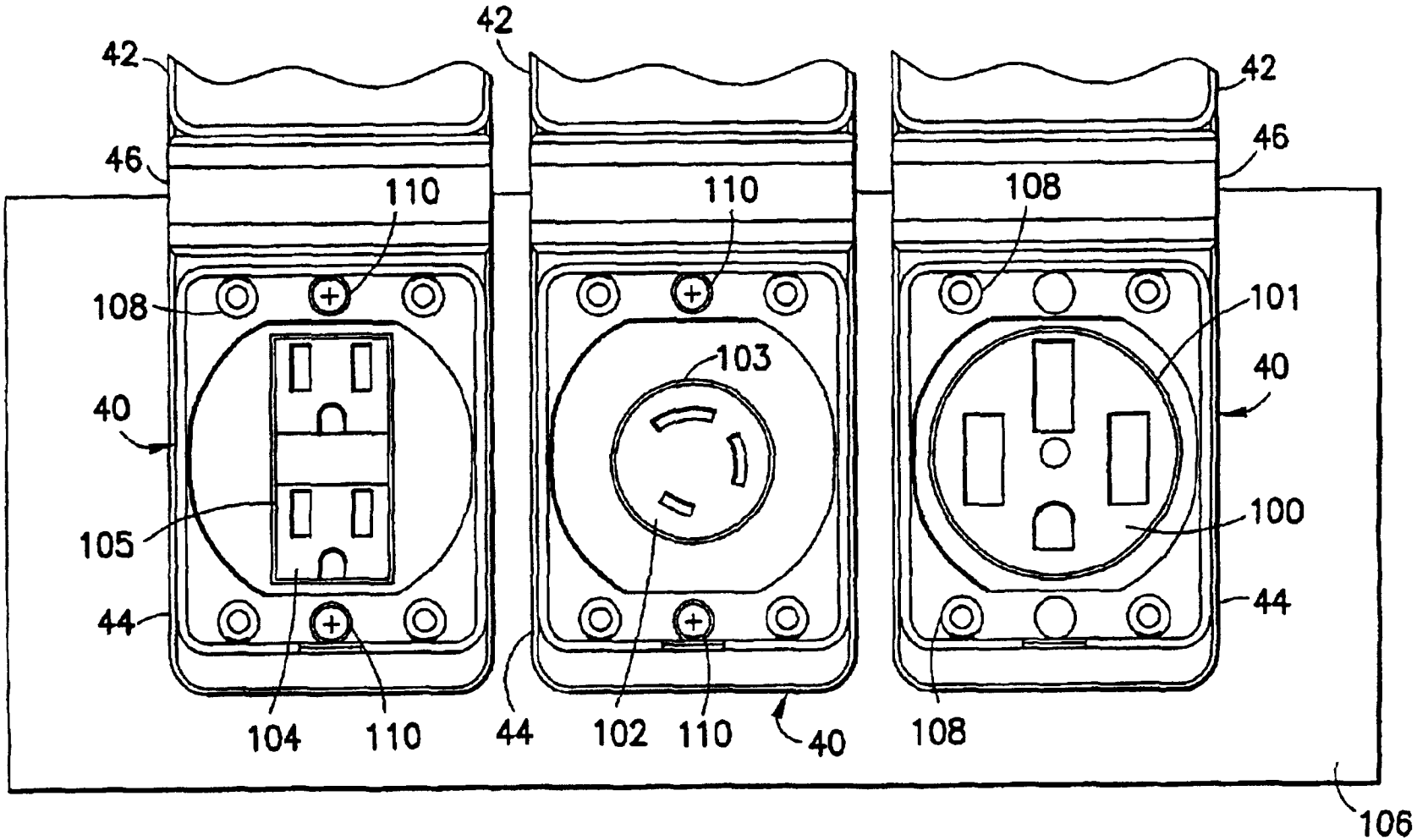
FIG. 2 is a drawing showing a front view of a power supply interface in accordance with one embodiment of the present invention.

For the purpose of illustration, an exemplary panel supporting a plurality of electrical receptacles is shown in FIG. 2. These receptacles will be connected to respective auxiliary power supplies, not shown in FIG. 2. Reference numeral 106 in FIG. 2 designates a panel or a portion of a chassis of a power supply unit, e.g., a welder/generator. The exemplary panel 106 is shown as having three openings respectively designated 101, 103, 105. Three electrical receptacles 100, 102, 104 are mounted to the panel 106 and have respective socket ends that project through the respective openings 101, 103, 105. As seen in FIG. 2, the socket end of receptacle 100 has a generally circular geometric configuration of relatively larger radius, the socket end of receptacle 102 has a generally circular geometric configuration of relatively smaller radius, and the socket end of receptacle 104 has a generally rectangular geometric configuration. In one embodiment, receptacle 100 provides 50 amps of 120–240 V single-phase power; receptacle 102 provides 20 amps of 240 V power; and receptacle 104 is a standard 20-amp, 110-V ground fault power supply for power tools.

In accordance with one embodiment of the present invention, each of the three receptacles is covered by a respective universal water-impermeable receptacle cover 40 made from molded plastic and comprising an adapter 44 attached to the panel and a lid 42 that is connected to the adapter 43 by a flexible membrane 46 that forms a living hinge. The living hinge allows the lid 42 to be moved relative to the adapter 44 between open and closed positions. FIG. 2 shows the lids in respective open positions that are unlikely to occur in actual practice due to the effects of gravity and the memory of the living hinge. In actual practice, the lids may adopt positions that are more horizontal than vertical (assuming the panel is vertically disposed).

The adapter 44 of each receptacle cover 40 is fastened to the panel by a respective set of four rivets 108 located at the corners of a rectangle. The receptacle 104 is attached to the panel 106 by means of a pair of screws 110. The same is true for receptacle 102. Receptacle 100, however, is attached to the panel 106 by means of four screws not visible behind the adapter 44 of the receptacle cover 40. Although not visible in FIG. 2, each receptacle cover has a respective gasket interposed between the adapter 44 and the panel 106.

Figure 4:
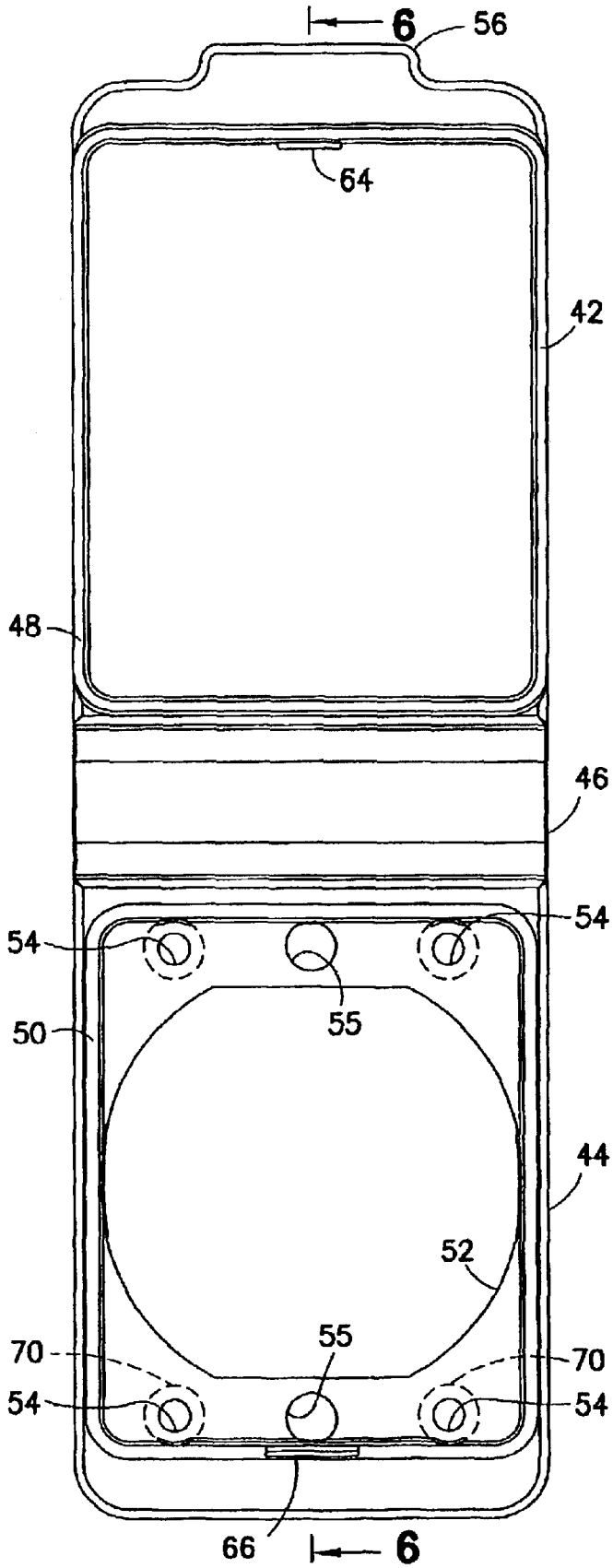
FIG. 4 is a drawing showing a front view of the receptacle cover depicted in FIG. 3.

The aperture in each adapter 44 has a geometric configuration that is different than the geometric configuration of the socket end of each of the electrical receptacles 100, 102, 104. In the disclosed embodiment, the aperture has a periphery that is generally in the shape of a circle that has been truncated along mutually diametrally opposed secants. More precisely, the aperture may comprise a pair of truncated semicircles that are connected by short straight segments, as best seen in FIG. 4.

Figure 3:
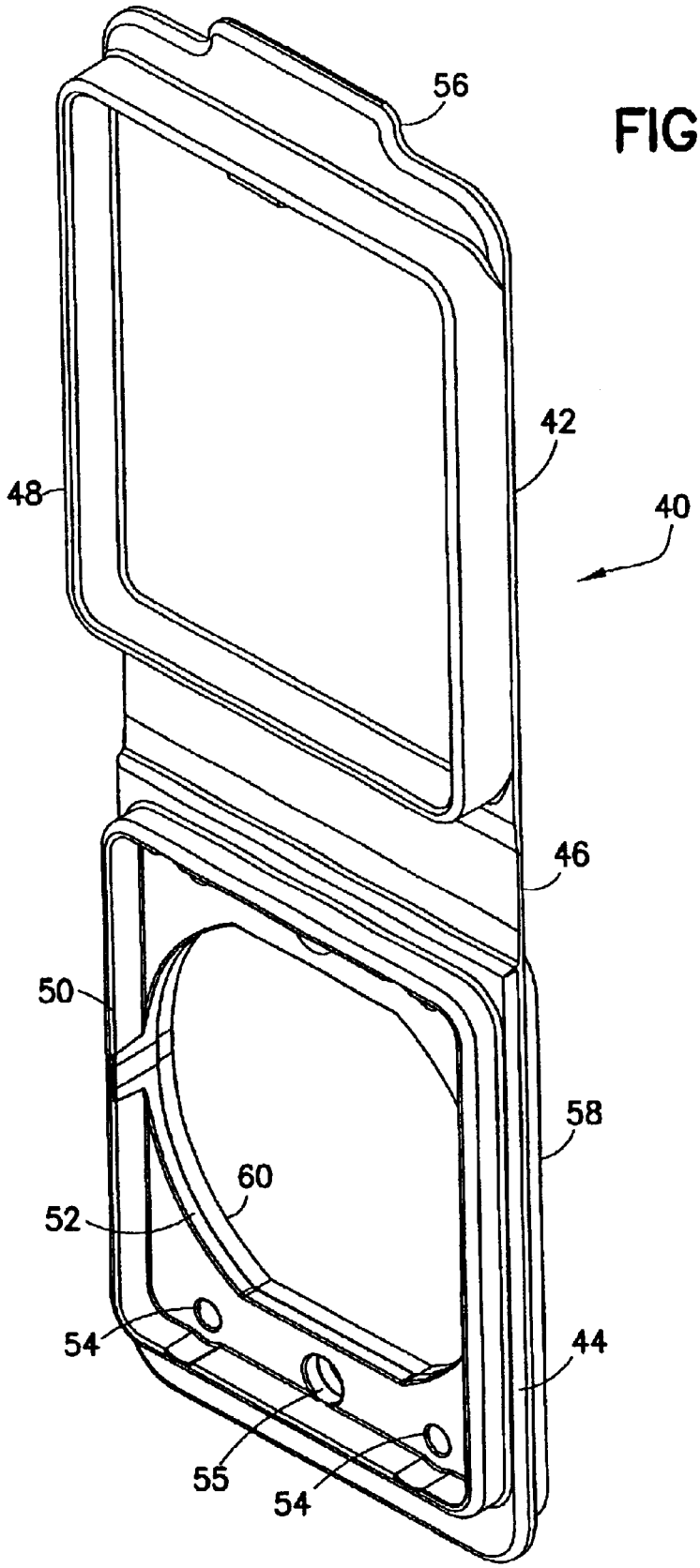
FIG. 3 is a drawing showing an isometric view of a fully open receptacle cover and associated gasket in accordance with one embodiment of the present invention.
Figure 7:
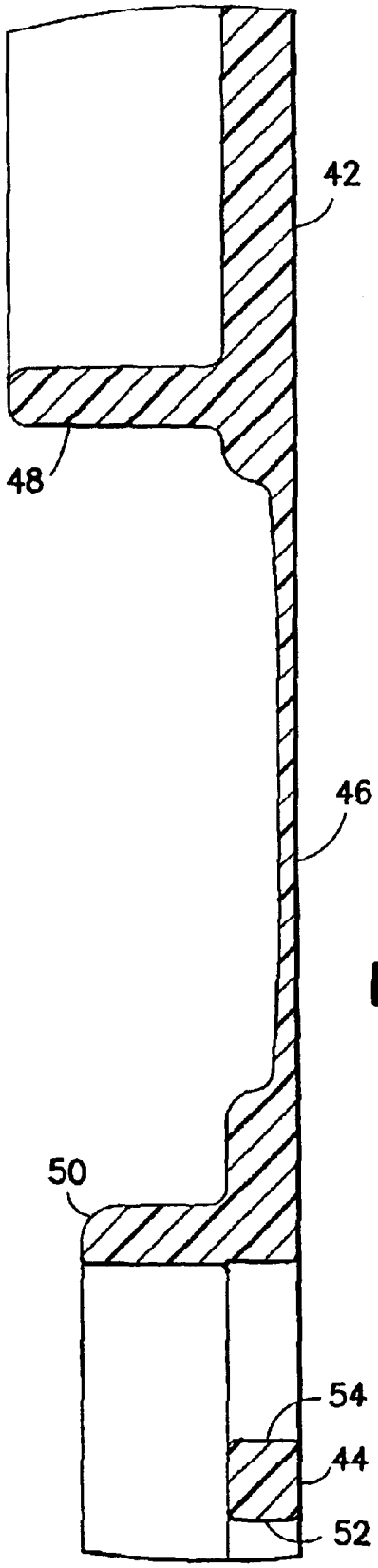
FIG. 7 is a drawing showing a magnified sectional view of the portion of the receptacle cover inside the dashed circle designated by a boldface numeral 7 in FIG. 6.

A universal receptacle cover 40 in accordance with one embodiment of the invention is shown in FIG. 3. This receptacle cover comprises an adapter 44 connected to a lid 42 by means of a flexible web 46. Preferably, the entire receptacle cover is made of a plastic material, such as low-density polyethylene or a material having substantially functionally equivalent properties. As best seen in FIG. 7, the lid 42 and the adapter 44 are thicker than the web 46, the web 46 being sufficiently thin to render it flexible, but sufficiently thick to withstand the stresses to which the cover will be subjected during normal usage.

Figure 5:
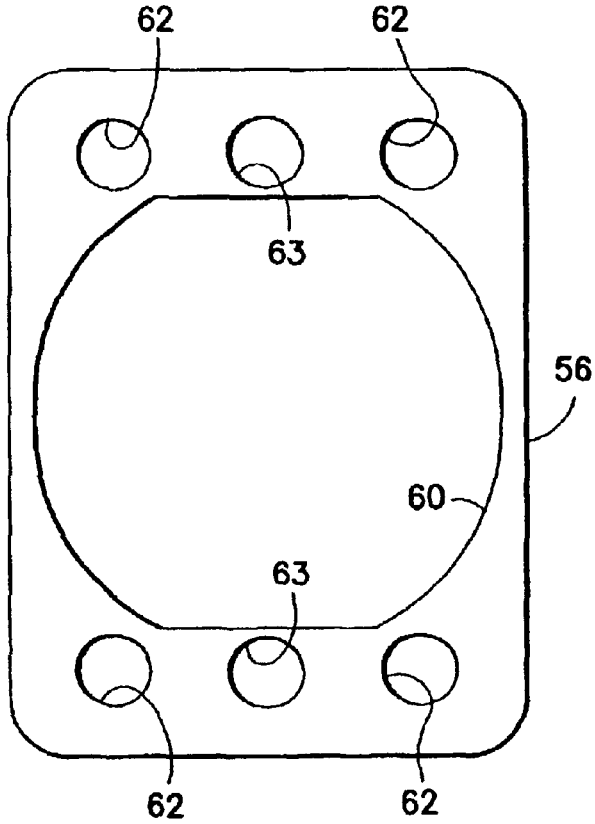
FIG. 5 is a drawing showing a front view of the gasket depicted in FIG. 3.

The adapter 44 has a central main aperture 52 that matches and is aligned with an aperture 60 formed in a gasket 58 (see FIG. 3). The adapter also has respective throughholes 54 for fasteners positioned at four corners of a rectangle, as best seen in FIG. 4. Respective bosses 70 (indicated by dashed circles in FIG. 4) project from the underside of the adapter 44, each boss 70 being an annular projection having a hole that is an extension of the respective throughhole 54. These bosses in turn fit inside respective holes 62 formed in the gasket 58 when the gasket is placed against the underside of the adapter 44. This arrangement prevents the gasket from being collapsed when the receptacle cover is mounted to a power supply chassis by the tightening of fasteners (not shown) that pass through the throughholes 54 of the adapter and respective throughholes (not shown) in the power supply chassis. In addition, the adapter 44 has a pair of throughholes 55 disposed midway between the respective pairs of smaller throughholes 54 (shown in FIG. 4), while the gasket 56 has a pair of throughholes 63 midway disposed between the respective pairs of throughholes 62 (shown in FIG. 5) and aligned with the throughholes 55 in the adapter. These aligned holes provide access to screws 110 (see FIG. 2) that fasten the receptacle 102 or 104 to the power supply chassis 106 and allow the receptacle to be removed without removing the receptacle cover.

The receptacle cover 40 is attached to the power supply chassis 106 (see FIG. 10) with the gasket 58 sandwiched between the underside of the adapter 44 and a corresponding area of the exterior surface of the power supply chassis that surrounds the socket ends projecting through apertures in the power supply chassis. For example, the gasket 58 would lie against the exterior surface of the power supply chassis 106, while the socket end 112 of the receptacle 100 projects through the apertures 60 and 52 respectively formed in the gasket 58 and adapter 44.

Figure 10:
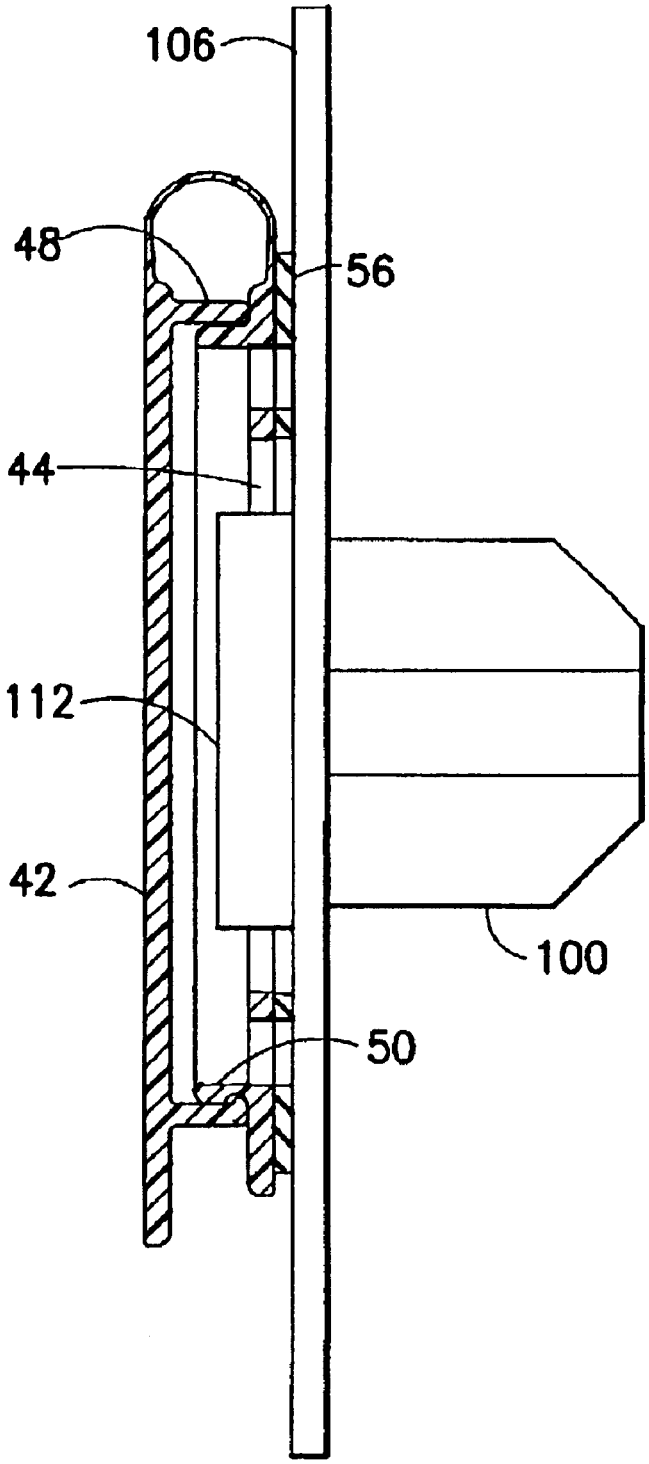
FIG. 10 is a drawing showing a sectional view of the receptacle cover in a closed state and mounted to a power supply chassis.

FIG. 4 shows the receptacle cover 40 in an open state, while FIG. 10 shows the receptacle cover in a closed state. The lid 42 comprises a closed wall 48 that projects generally perpendicularly from one side of the cover. As best seen in FIG. 4, the shape of closed wall 48 is a rectangle having rounded corners. As shown in FIG. 4, the lid 42 has no openings. The lid 42 functions as a closure when wall 48 is brought into engagement with a closed wall 50 that projects generally perpendicularly from one side of the adapter 44. The shape of closed wall 50 is also a rectangle having rounded corners. To close the receptacle cover, the lid 42 is swung around until wall 48 engages and surrounds wall 50. During this motion, the flexible web 46 becomes folded into a U-shape (seen in FIG. 10). Movement of the side of the lid 42 closest to the adapter 44 is constrained by its connection to the flexible web 46.

Figure 8:
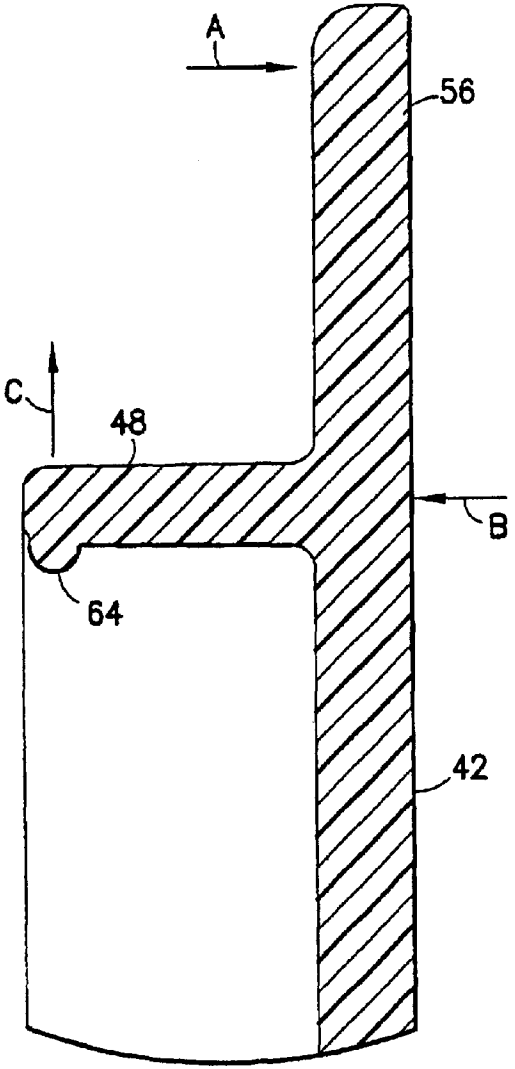
FIG. 8 is a drawing showing a magnified sectional view of the portion of the receptacle cover inside the dashed circle designated by a boldface numeral 8 in FIG. 6.

The walls 48 and 50 are disposed on the same side of the cover and have matching shapes that provide a form-fitting relationship when wall 48 of the lid 42 is pressed onto wall 50 of the adapter 44, as seen in FIG. 10. Another way of stating the positional relationship is that the lid 42 and wall 48 form a cap that is pushed onto the neck formed by wall 50, thereby covering the aperture 52 in adapter 44. As shown in FIG. 8, the inner peripheral edge of the top of wall 48 and the outer peripheral edge of the top of wall 50 are rounded to facilitate the insertion of one wall inside the other without snagging.

The walls 48 and 50 each have a constant height, with the height of the wall 50 being less than the height of wall 48. Thus, when the wall 50 is nested inside wall 48, the main section of lid 42 is in generally parallel and confronting relationship to the adapter 44, as seen in FIG. 10. In this closed state of the receptacle cover, the space between lid 42 and adapter 44, and inside walls 48 and 50, is substantially sealed against the admission of water. The walls 48 and 50 form a substantially watertight seal along the entire periphery, while the gasket 56 seals the interstice between the adapter 44 and the power supply chassis 106. The gasket is made of a compressible material such as closed-cell neoprene sponge or a functionally equivalent material suitable for use in water-resistant products. Since the terminal end of the receptacle resides within this sealed space, water from the exterior cannot seep into the interstice between the receptacle insulator and the chassis, thereby reducing the risk of a short circuit when the equipment is exposed to wet conditions.

As seen in FIG. 3, the apertures 52 and 60 in the adapter 44 and the gasket 56, respectively, have matching shapes. In this example, the perimeter of each aperture comprises a pair of mutually parallel, mutually diametrally opposed straight sections, the ends of which are connected to respective curved sections as previously described. The size and shape (i.e., the geometric configuration) of each aperture is such that receptacles of different sizes and different shapes can project through the aperture. In this sense, receptacle cover is universal because it is not limited by design to use with one specific receptacle, but rather with multiple different receptacles.

Figure 9:
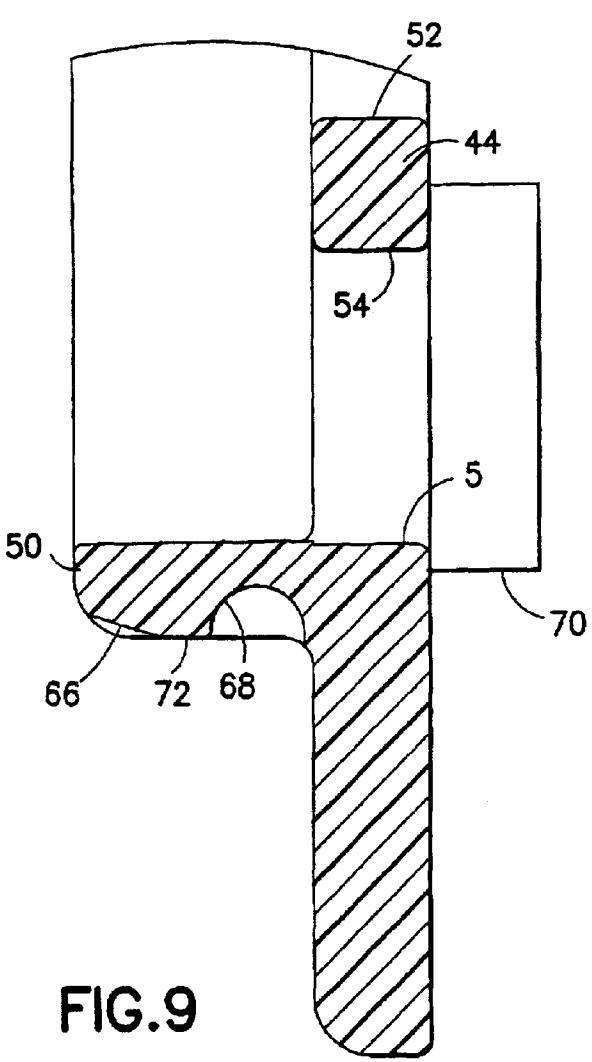
FIG. 9 is a drawing showing a magnified sectional view of the portion of the receptacle cover inside the dashed circle designated by a boldface numeral 9 in FIG. 6.

In accordance with a further aspect, means for latching the cover in a fixed position relative to the adapter are provided. Referring to FIG. 4, the straight section of closed wall 48 that runs parallel to and is remote from the flexible web has a rib 64 that projects inward and toward the flexible web 46. As best seen in FIG. 8, the rib 64 has a convex curved profile. As seen in FIG. 9, the straight section of dosed wall 50 that runs parallel to and is remote from the flexible web has a groove 68 formed on its exterior that mates with the rib 64 when the receptacle cover is closed. The groove 68 has a concave curved profile that matches the convex curved profile of the rib 64. More specifically, when the closed wall 50 is inserted into the space bounded by the closed wall 48, the rib 64 will impinge against an inclined surface 66 of a beveled recess formed on the exterior of the top portion of wall 50. The inclined surface 66 is disposed so that the rib 64 and inclined surface are aligned when the receptacle cover is folded and the closed walls 48 and 50 are brought into alignment. As the wall 48 is pressed onto the wall 50, the rib 64 slides along the inclined surface 66 and is cammed outward. The abutting sections of walls 48 and 50 seen in FIGS. 7 and 8 respectively are flexible enough to allow the rib 64 to slide past the plateau 70 (see FIG. 9) and then snap into the groove 68 (as shown in FIG. 10), thereby latching the receptacle cover closed.

The lid 42 is further provided with an extension 56 (see FIG. 4) that serves as a handle or grasping tab. This handle can be used to open the receptacle cover. Referring to FIG. 8, it can be seen that the application of oppositely directed forces at the locations indicated by the arrows respectively labeled A and B will cause the section of wall 48 that carries the rib 64 to flex outward in direction C. More precisely, the rib 64 will be pivoted about the fulcrum point, i.e., the point at which force B is applied. This in turn causes the rib 64 to displace out of and thereby disengage from the groove 66. In this state, the closed wall 48 is unlatched and the lid 42 can be moved to uncover the receptacle (or receptacles). The user may then proceed to plug the end of a cable into each receptacle.

Figure 6:
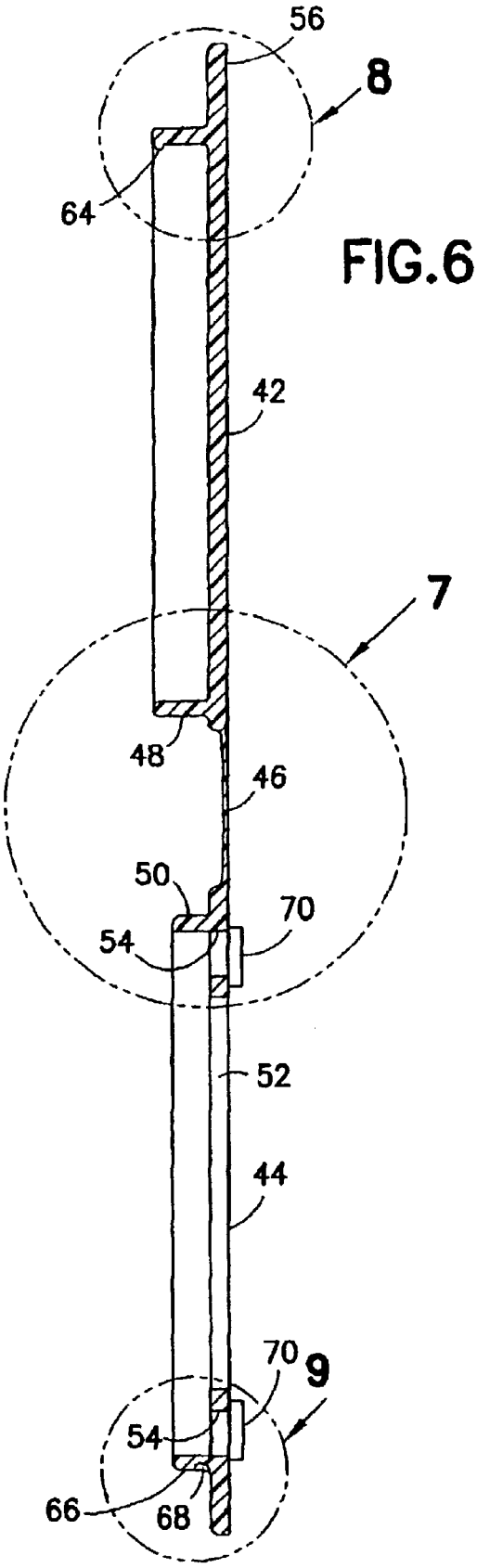
FIG. 6 is a drawing showing a sectional view of the receptacle cover depicted in FIG. 4. The section is taken along line 6—6 shown in FIG. 4.

The receptacle cover disclosed herein is advantageously formed by molding, in which case the lid 42 and the adapter 44 are each integrally formed with the flexible web 46. In short, the entire structure shown in FIG. 6 is a monolithic molded body made of plastic material.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "geometric configuration" includes both size and shape, and geometric configurations are "different" if they have different shapes or the same shape but different sizes.

What is claimed is:

1. A power supply interface comprising:

a chassis comprising first and second openings, said first opening having a first geometric configuration and said second opening having a second geometric configuration different than said first geometric configuration;

a first electrical receptacle mounted to said chassis and comprising a socket end that projects through said first opening and is designed to receive a plug of a first type;

a second electrical receptacle mounted to said chassis and comprising a socket end that projects through said second opening and is designed to receive a plug of a second type different than said first type;

a first receptacle cover comprising an adapter mounted to said chassis and a lid connected to said adapter by a living hinge, wherein said adapter comprises an aperture having a third geometric configuration different than said first and second geometric configurations, and said first receptacle cover covers said socket end of said first electrical receptacle when said lid of said first receptacle cover is coupled to said adapter of said first receptacle cover; and a second receptacle cover substantially identical in structure to said first receptacle cover, wherein said second receptacle cover covers said socket end of said second electrical receptacle when said lid of said second receptacle cover is coupled to said adapter of said second receptacle cover.

2. The power supply interface as recited in claim 1, wherein said chassis comprises a first set of holes arranged proximal to said first opening, and a second set of holes arranged proximal to said second opening, said first receptacle cover comprises a third set of holes that are respectively aligned with said first set of holes, and said second receptacle cover comprises a fourth set of holes that are respectively aligned with said third set of holes, further comprising a first set of fasteners that respectively penetrate the holes of said first and third sets, and a second set of fasteners that respectively penetrate the holes of said second and fourth sets.

3. The power supply interface as recited in claim 1, wherein for each of said first and second receptacle covers, said adapter comprises a first closed wall that projects away from said chassis, and said lid comprises a second closed wall that projects toward said chassis when said lid is coupled to said adapter, said first closed wall fitting inside said second closed wall in said coupled state.

4. The power supply interface as recited in claim 3, wherein said first and second closed walls form a watertight seal in said coupled state.

5. The power supply interface as recited in claim 1, wherein said aperture of said adapter has a periphery comprising mutually diametrally opposed first and second straight sections, first and second curved sections respectively connected to the ends of said first straight section, and third and fourth curved sections respectively connected to the ends of said second straight section.

6. The power supply interface as recited in claim 1, wherein said first geometric configuration has a generally rectangular shape, and said second geometric configuration has a generally circular shape.

7. The power supply interface as recited in claim 1, wherein said socket end of said first electrical receptacle has a generally rectangular shape, and said socket end of said second electrical receptacle has a generally circular shape.

8. The power supply interface as recited in claim 1, wherein said first geometric configuration has a generally circular shape with a first radius, and said second geometric configuration has a generally circular shape with a second radius different than said first radius.

9. The power supply interface as recited in claim 1, wherein said socket end of said first electrical receptacle has a generally circular shape with a first radius, and said socket end of said second electrical receptacle has a generally circular shape with a second radius different than said first radius.

10. The power supply interface as recited in claim 1, wherein said aperture of said adapter of said first receptacle cover overlaps and extends beyond said first opening in said chassis, and said aperture of said adapter of said second receptacle cover overlaps with and extends beyond said second opening in said chassis.

11. The power supply interface as recited in claim 1, wherein for each of said first and second receptacle covers, said adapter, said lid and said living hinge are integrally formed.

12. The power supply interface as recited in claim 1, further comprising a first gasket disposed between said adapter of said first receptacle cover and said chassis, and a second gasket disposed between said adapter of said second receptacle cover and said chassis.

13. A power supply unit comprising:

a generator capable of generating a first electrical power at a first output terminal and a second electrical power different than said first electrical power at a second output terminal;

a chassis comprising first and second openings, said first opening having a first geometric configuration and said second opening having a second geometric configuration different than said first geometric configuration;

a first electrical receptacle mounted to said chassis and electrically coupled to said first output terminal, said first electrical receptacle comprising a socket end that projects through said first opening and is designed to receive a plug of a first type;

a second electrical receptacle mounted to said chassis and electrically coupled to said second output terminal, said second electrical receptacle comprising a socket end that projects through said second opening and is designed to receive a plug of a second type different than said first type;

a first receptacle cover comprising an adapter mounted to said chassis and a lid connected to said adapter by a flexible web, wherein said adapter comprises an aperture having a third geometric configuration different than said first and second geometric configurations, and said first receptacle cover covers said socket end of said first electrical receptacle when said lid of said first receptacle cover is coupled to said adapter of said first receptacle cover; and a second receptacle cover substantially identical in structure to said first receptacle cover, wherein said second receptacle cover covers said socket end of said second electrical receptacle when said lid of said second receptacle cover is coupled to said adapter of said second receptacle cover.

14. A power supply interface comprising:

a panel;

a first electrical receptacle mounted to said panel and comprising a first socket end that has a first geometric configuration and is designed to receive a plug of a first type;

a second electrical receptacle mounted to said panel and comprising a second socket end that has a second geometric configuration different than said first geometric configuration and is designed to receive a plug of a second type different than said first type;

a first receptacle cover comprising an adapter mounted to said panel and a lid connected to said adapter by a flexible web, wherein said adapter comprises an aperture having a third geometric configuration different than said first and second geometric configurations, and said first receptacle cover covers said first socket end of said first electrical receptacle when said lid is coupled to said adapter; and a second receptacle cover substantially identical in structure to said first receptacle cover, wherein said second receptacle cover covers said second socket end of said second electrical receptacle when said lid of said second receptacle cover is coupled to said adapter of said second receptacle cover, wherein said first socket end of said first electrical receptacle projects through said aperture in said adapter of said first receptacle cover, and said second socket end of said second electrical receptacle projects through said aperture in said adapter of said second receptacle cover.

15. The power supply interface as recited in claim 14, wherein said panel comprises first and second sets of holes, said first receptacle cover comprises a third set of holes that are respectively aligned with said first set of holes, and said second receptacle cover comprises a fourth set of holes that are respectively aligned with said third set of holes, further comprising a first set of fasteners that respectively penetrate the holes of said first and third sets, and a second set of fasteners that respectively penetrate the holes of said second and fourth sets.

16. The power supply interface as recited in claim 14, wherein for each of said first and second receptacle covers, said adapter comprises a first closed wall that projects away from said panel, and said lid comprises a second closed wall that projects toward said panel when said lid is coupled to said adapter, said first closed wall fitting inside said second closed wall in said coupled state.

17. The power supply interface as recited in claim 16, wherein said first and second closed walls form a watertight seal in said coupled state.

18. The power supply interface as recited in claim 14, wherein said aperture of said adapter has a periphery comprising mutually diametrally opposed first and second straight sections, first and second curved sections respectively connected to the ends of said first straight section, and third and fourth curved sections respectively connected to the ends of said second straight section.

19. The power supply interface as recited in claim 14, wherein said first geometric configuration has a generally rectangular shape, and said second geometric configuration has a generally circular shape.

20. The power supply interface as recited in claim 14, wherein said first geometric configuration has a generally circular shape with a first radius, and said second geometric configuration has a generally circular shape with a second radius different than said first radius.

21. The power supply interface as recited in claim 14, wherein for each of said first and second receptacle covers, said adapter, said lid and said flexible web are integrally formed.

22. The power supply interface as recited in claim 14, further comprising a first gasket disposed between said adapter of said first receptacle cover and said panel, and a second gasket disposed between said adapter of said second receptacle cover and said panel.

23. A method for waterproofing exposed first and second socket ends of first and second electrical receptacles mounted to a panel of a power supply unit, said first and second socket ends having different geometric configurations, respective major portions of said first and second electrical receptacles being disposed on one side of said panel, and said first and second socket ends projecting at least partly on the other side of said panel, comprising the following steps:

molding first and second receptacle covers having substantially identical structure, each of said receptacle covers comprising an adapter with an aperture, a lid and a web connecting said lid to said adapter, said lid and said adapter forming a watertight seal when said lid is pressed onto said adapter, thereby closing said respective receptacle cover; and fastening said adapters of said first and second receptacle covers to said panel in respective positions such that said first receptacle cover in a closed state covers said first socket end as it projects through said aperture in said adapter of said first receptacle cover, while said second receptacle cover in a closed state covers said second socket end as it projects through said aperture in said adapter of said first receptacle cover.

24. The method as recited in claim 23, further comprising the steps, performed prior to said fastening step, of placing a first gasket between said adapter of said first receptacle cover and said panel, and placing a second gasket between said adapter of said second receptacle cover and said panel.

* * * * *